US011326829B2

(12) United States Patent
Floquet

(10) Patent No.: US 11,326,829 B2
(45) Date of Patent: May 10, 2022

(54) PORTABLE REFRIGERATED CABINET

(71) Applicant: Benoit Floquet, Buros (FR)

(72) Inventor: Benoit Floquet, Buros (FR)

(73) Assignee: Benoit Floquet, Buros (FR)

( * ) Notice: Subject to any disclaimer, the term of this patent is extended or adjusted under 35 U.S.C. 154(b) by 356 days.

(21) Appl. No.: 16/481,557

(22) PCT Filed: Feb. 5, 2018

(86) PCT No.: PCT/FR2018/000012
§ 371 (c)(1),
(2) Date: Jul. 29, 2019

(87) PCT Pub. No.: WO2018/146389
PCT Pub. Date: Aug. 16, 2018

(65) Prior Publication Data

US 2019/0368806 A1 Dec. 5, 2019

(30) Foreign Application Priority Data

Feb. 10, 2017 (FR) ..... 1700153

(51) Int. Cl.
*F25D 23/04* (2006.01)
*E05B 65/00* (2006.01)
(Continued)

(52) U.S. Cl.
CPC ..... *F25D 23/04* (2013.01); *E05B 65/0042* (2013.01); *F25D 23/028* (2013.01);
(Continued)

(58) Field of Classification Search
CPC ..... F25D 23/04; F25D 23/028; F25D 23/065; F25D 2323/061; F25D 2325/023; F25D 2400/16; E05B 65/0042
(Continued)

(56) References Cited

U.S. PATENT DOCUMENTS

2006/0107676 A1* 5/2006 Fockter ..... F25D 23/023 62/246
2010/0256800 A1* 10/2010 Heffron ..... G07F 11/62 700/214
(Continued)

FOREIGN PATENT DOCUMENTS

EP 2638825 A1 * 9/2013 ..... A47F 3/0447
EP 2638825 A1 9/2013
(Continued)

OTHER PUBLICATIONS

International Search Report and Written Opinion in corresponding International Patent Application No. PCT/FR2018/000012 dated May 14, 2018. (English translation attached.) 18 pages.
International Preliminary Report on Patentability in corresponding International Patent Application No. PCT/FR2018/000012 dated Aug. 13, 2019. 8 pages.

*Primary Examiner* — Steve S Tanenbaum
(74) *Attorney, Agent, or Firm* — Leason Ellis LLP

(57) ABSTRACT

The present invention (1) relates to a folding and portable refrigerated cabinet comprising a locked-compartments structure, made up of the reversible combination of three elements:—a plinth,—a folding exterior structure positioned on the plinth,—a folding interior structure with compartments set into the exterior structure, the plinth containing a refrigeration unit, the folding exterior structure comprising a hermetically sealed facade closed by a refrigeration door, the other sides being covered with a removable isothermal insulation means (4), the folding interior structure with compartments being made up of at least one module comprising walls delimiting at least one closed volume inside the folding exterior structure, said closed volume constituting a compartment (24, 25, 26, 27) provided with a mobile partition allowing the volume of the compartment to be varied as two sub-compartments (24'/24", 25'/25", 26'/26",
(Continued)

27'/27"), each of said compartments and sub-compartments being closed by a door comprising a secured-access means.

10 Claims, 9 Drawing Sheets

(51) Int. Cl.
*F25D 23/02* (2006.01)
*F25D 23/06* (2006.01)

(52) U.S. Cl.
CPC ..... *F25D 23/065* (2013.01); *F25D 2323/061* (2013.01); *F25D 2325/023* (2013.01); *F25D 2400/16* (2013.01)

(58) Field of Classification Search
USPC ..... 62/298
See application file for complete search history.

(56) References Cited

U.S. PATENT DOCUMENTS

2012/0209763 A1* 8/2012 Zabbatino ..... G06Q 30/0645 705/39
2013/0047646 A1* 2/2013 Jafa ..... A47F 3/0404 62/125
2015/0075208 A1* 3/2015 Lockwood ..... F25D 11/00 62/407

FOREIGN PATENT DOCUMENTS

FR 2689221 A1 10/1993
WO 2005044060 A1 5/2005

* cited by examiner

PORTABLE REFRIGERATED CABINET

CROSS-REFERENCE TO RELATED PATENT APPLICATIONS

This application is a U.S. National Stage Application under 35 U.S.C. § 371 of International Patent Application No. PCT/FR2018/000012, filed Feb. 5, 2018, which claims the benefit of priority under 35 U.S.C. Section 119 of French Patent Application number FR 1700153 filed Feb. 10, 2017, both of which are incorporated by reference in their entireties. The International Application was published on Aug. 16, 2018, as International Publication No. WO 2018/146389 A1.

FIELD OF THE INVENTION

The present invention relates to a foldable, easily portable refrigerated cabinet. More specifically, it relates to a device comprising a structure with closed compartments having a security-protected opening system.

BRIEF DESCRIPTION OF THE PRIOR ART

With the growth of online shopping and deliveries of fresh produce, there is the need to be able to place perishable food products in refrigerated structures that are accessible to customers.

It is in response to this need that refrigerated consignments have grown in recent years in the vicinity of supermarkets. FR2689221 discloses a device of this kind; it relates to a chilled cabinet divided into refrigerated, modular compartments, with each compartment being equipped with a door that can be locked by a mechanical lock with a key or an electromagnetic lock. These devices are, however, disadvantageous in that they are large and bulky, and most of all cannot be moved. They therefore cannot be used in different delivery locations.

Other inventions overcome the drawback of bulkiness by proposing foldable refrigerated structures. U.S. Pat. No. 646,699 thus discloses a device that is intended to be fixed to the wall of a building for storing delivered goods and has the special feature of being able to be opened out when it is being used and then folded away by means of a system of foldable, insulating walls. This device further comprises a system for locking the compartment.

Despite this, the use of these devices remains limited, since they cannot be moved and used in different delivery locations.

Foldable, portable refrigerated cabinets have therefore been designed, such as that disclosed in CN20463014, which can be fully dismantled and is formed by a base on casters, a telescopic shelf structure covered by an insulating cover, and a removable refrigerating unit.

However, none of the movable refrigerated cabinets of this type comprise a lockable compartment system that allows fresh produce to be delivered in a security-protected manner.

The present invention aims to overcome all of these drawbacks by proposing a device that makes it possible to store fresh produce in locked, refrigerated compartments and can be integrally and easily folded, dismantled, and transported.

BRIEF DESCRIPTION OF THE FIGURES

In this description, reference is made to the appended drawings, in which.

SUMMARY OF THE INVENTION

Figure 1:
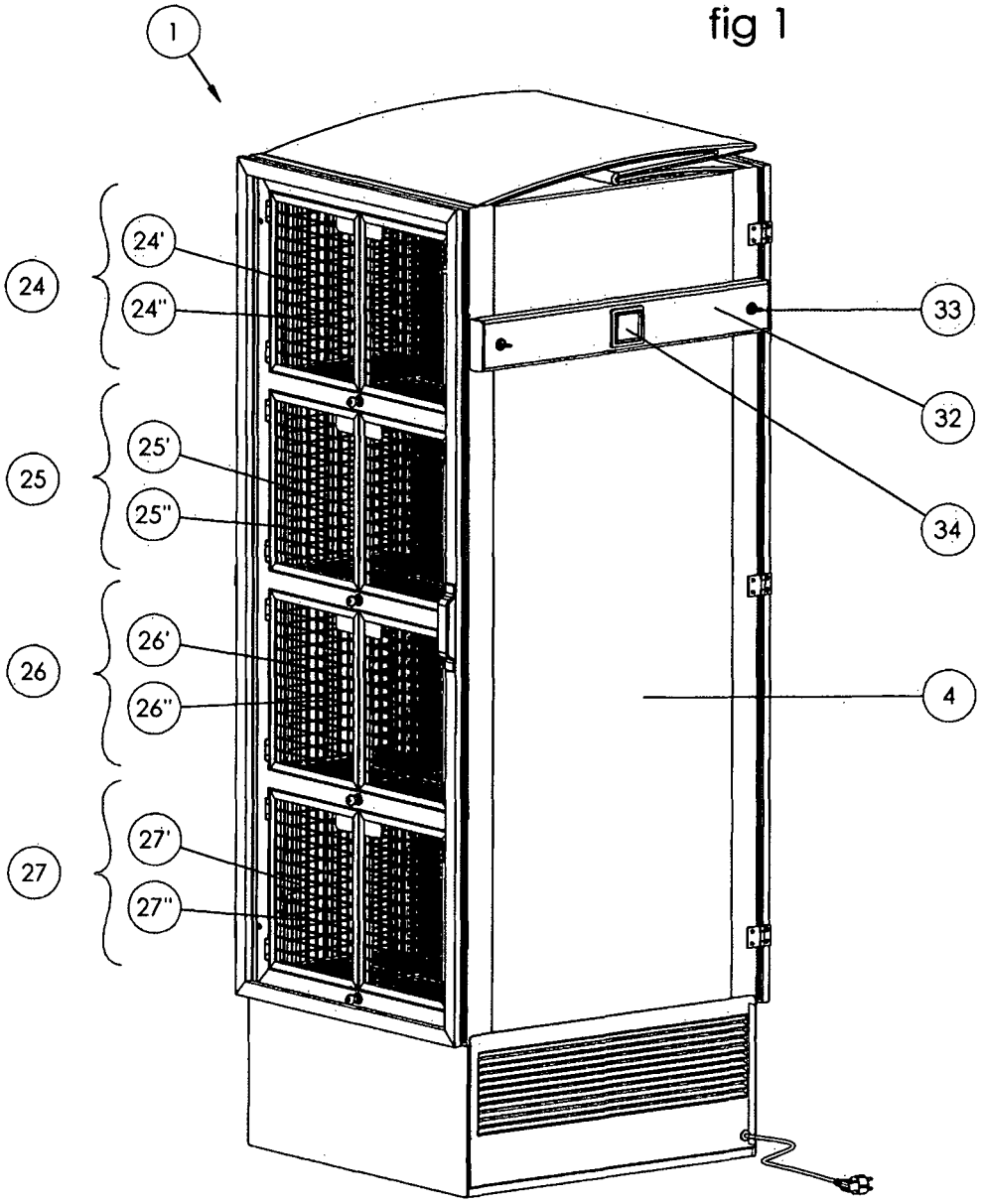
FIG. 1 is an isometric view of the device

The present invention makes it possible to improve on what already exists by proposing a foldable and portable refrigerated device which allows products to be stored in compartments with security-protected openings.

It relates to a movable, portable, refrigerated device, which is formed by reversibly connecting three elements:

- a base,
- a foldable exterior structure positioned on the base,
- a foldable interior structure with compartments which is built into the foldable exterior structure, said base containing a refrigerating unit, said foldable exterior structure comprising at least one hermetic façade formed by a side closed by a refrigerator door, with the other sides of said structure being covered by a removable isothermal insulating means, said foldable interior structure with compartments being formed by at least one module comprising a façade frame, a vertical wire-screened wall parallel to said frame, and at least two horizontal wire-screened walls positioned between the frame and the vertical wall, the assembly delimiting at least one enclosed volume inside the foldable exterior structure, said enclosed volume forming a compartment comprising at least one movable partition that is fixed by a hinge to the vertical wall, said movable partition forming a means for adapting the volume of the compartment into two sub-compartments, each of said compartments and sub-compartments being closed by at least one door comprising a security-protected access means, said door being rigidly connected to the frame.

Preferably, the base and the foldable exterior structure comprise means for mutual rigid connection, and sealing means.

According to a variant, the foldable exterior structure and the foldable interior structure comprise means for mutual rigid connection.

Advantageously, the isothermal insulating means is rigidly connected to the foldable exterior structure by attachment means on the hermetic façade.

Preferably, at least two of the walls of the exterior structure comprise hinges forming folding means.

According to another embodiment, said horizontal walls of the foldable interior structure comprise hinges forming folding means.

Advantageously, the foldable interior structure comprises at least one means for locking said movable partition.

According to a preferred embodiment, the security-protected access means for said door of the foldable interior structure is a solenoid lock.

According to another variant, the security-protected access means for said door of the foldable interior structure is an electric lock.

According to an advantageous embodiment of the invention, the device comprises a computerized reader connected to the security-protected access means for said door of the foldable interior structure, said computerized reader forming a means for controlling the opening of said door.

DETAILED DESCRIPTION OF PREFERRED EMBODIMENTS

According to a preferred embodiment, the device (1) according to the invention involves connecting a foldable exterior structure (2), a foldable interior structure (3), an isothermal cover (4), and a removable base (5) containing a refrigerating unit (6).

In the present description, the term "vertical" is used to indicate an axis which is vertical relative to the ground and on which the device (1) is positioned, and the term "horizontal" is used to indicate an axis which is horizontal relative to the ground and on which the device (1) is positioned.

Figure 2:
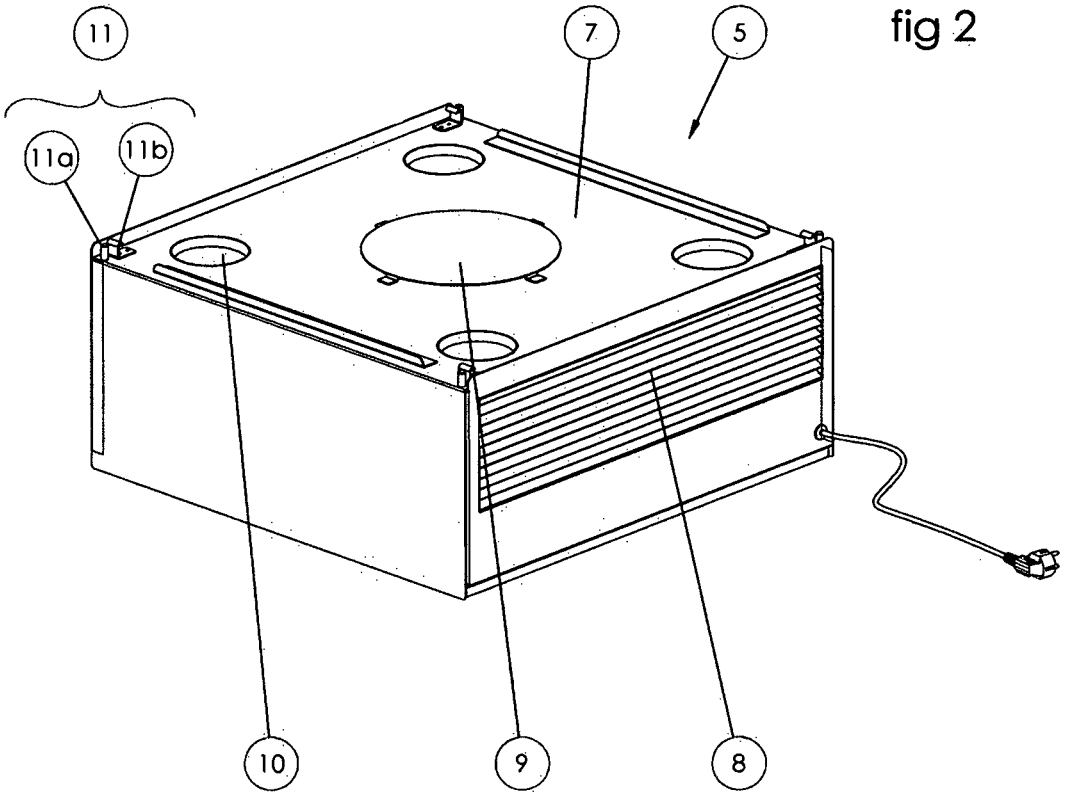
FIG. 2 is a view of the base

The base (5) [FIG. 2] of the device contains the refrigerating unit (6). Said unit makes it possible to reach and maintain a temperature suitable for keeping food inside the device (1).

The base (5) is in the form of a straight-sided square prism, with the two square faces being the lower part and the upper part (7) of the base, and the four side faces being rectangular. The base is supported on four casters (12) that comprise a locking brake and are fixed to the lower part of said base. The braked casters (12) make it possible to easily move the device (1) and then immobilize it once in the chosen position. At least one of the side walls of the base (5) is equipped with a ventilation grating (8) which allows the refrigerating unit (6) to be ventilated. In addition, one of the side walls comprises a hole through which the power cord of the refrigerating unit (6) is intended to pass. The upper face (7) of the base (5) comprises a circular opening (9) in the center thereof. A fan is located inside the base, under this opening (9), which optimizes the diffusion of the cold produced by the refrigerating unit (6), with the opening allowing this diffused air to circulate. The upper face (7) of the base also comprises four circular recesses (10). These recesses (10) are positioned on the same axis as the fixed casters under the unit, and will house the casters of another base (5) if it is necessary to stack several bases one on top of the other when the devices (1) are folded up, dismantled, and stored. There are means (11) for attaching the foldable exterior structure of the device (1) at each corner of the upper part (7) of the base (5). Each attachment means (11) is formed by a rod (11*a*) located on the periphery of the upper part (7) and a hook (11*b*) positioned behind the rod (11*a*). Each of the four rods (11*a*) is inserted into a hole of complementary shape and dimensions that is located in the lower part of the foldable exterior structure (2) and allows the foldable exterior structure (2) to be guided and held on the base (5). Each of the hooks (11*b*) is connected to a toggle-fastener attachment or a lever closure (13) on the foldable exterior structure (2), the toggle-fastener attachments (13) becoming locked in the hooks (11*b*), thus ensuring that the exterior structure (2) is locked on the base (5).

Figure 3:
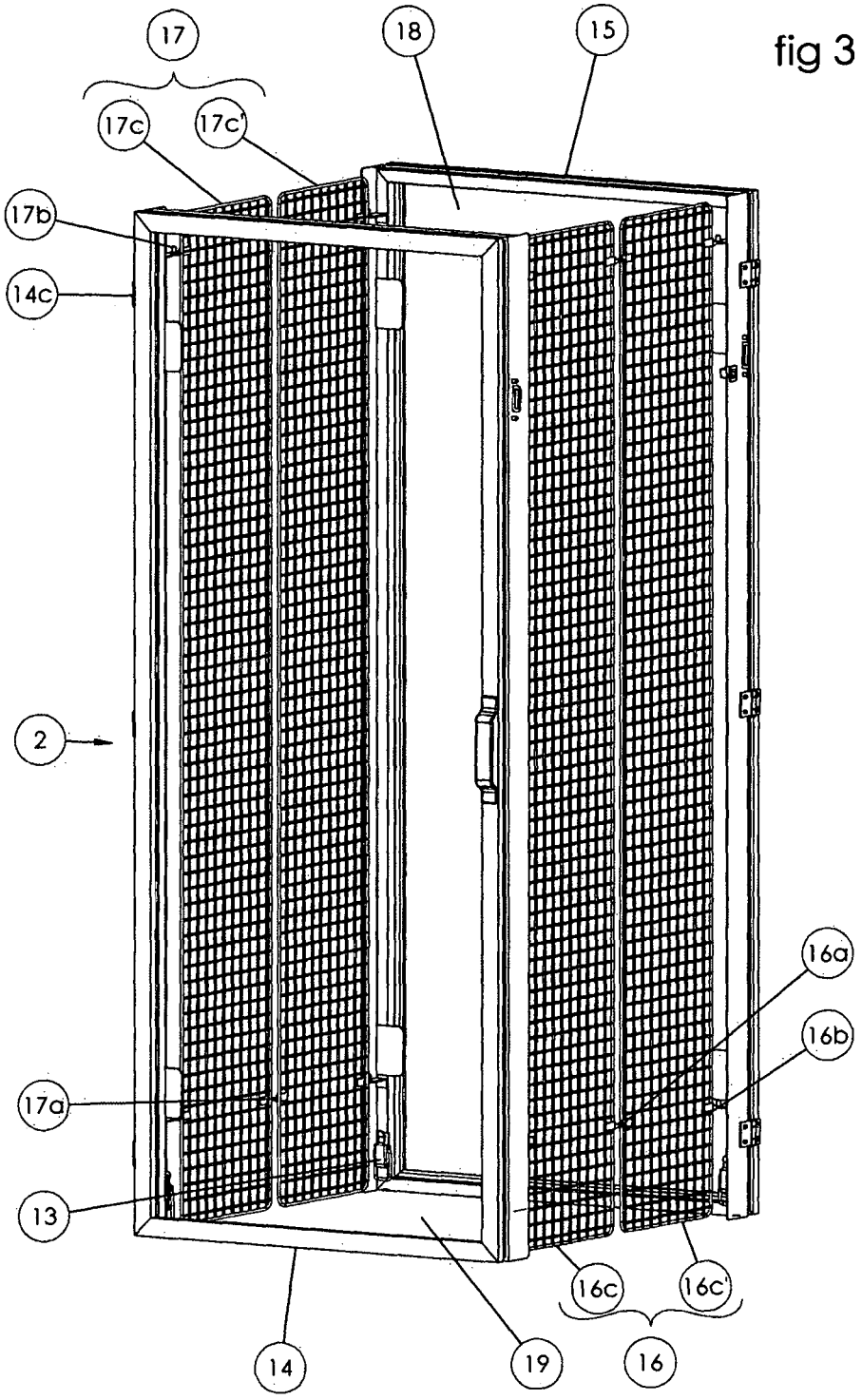
FIG. 3 is an isometric view of the opened-out exterior structure
Figure 4:
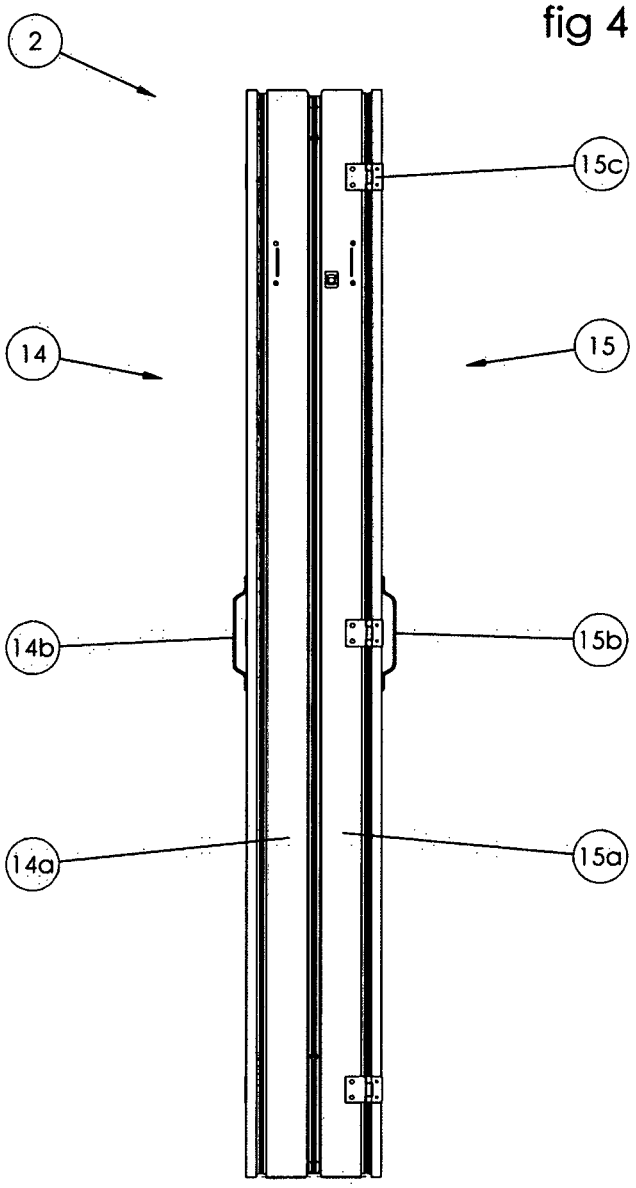
FIG. 4 is an isometric view of the folded-up exterior structure
Figure 5:
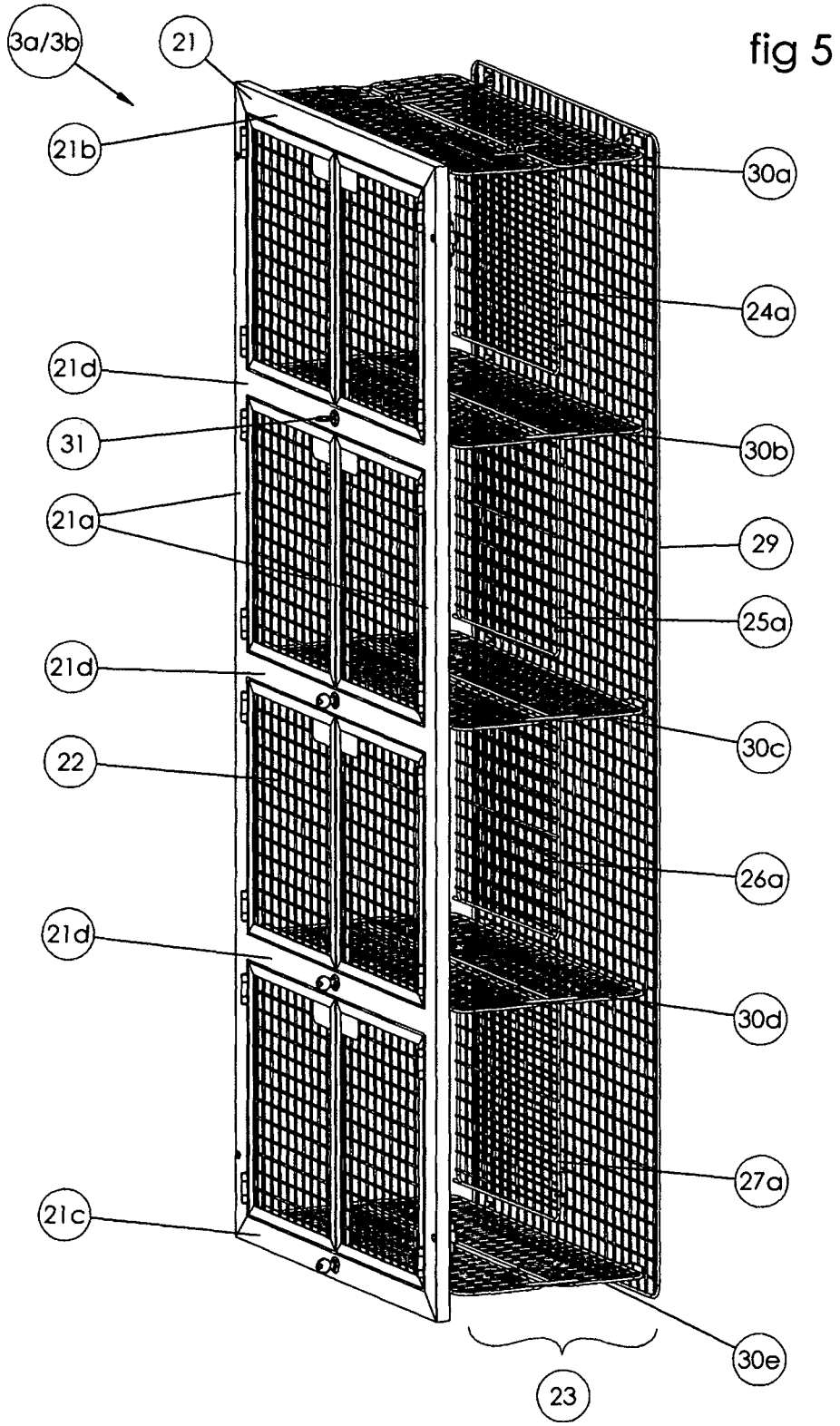
FIG. 5 is an isometric view of a module of the interior structure when opened out
Figure 6:
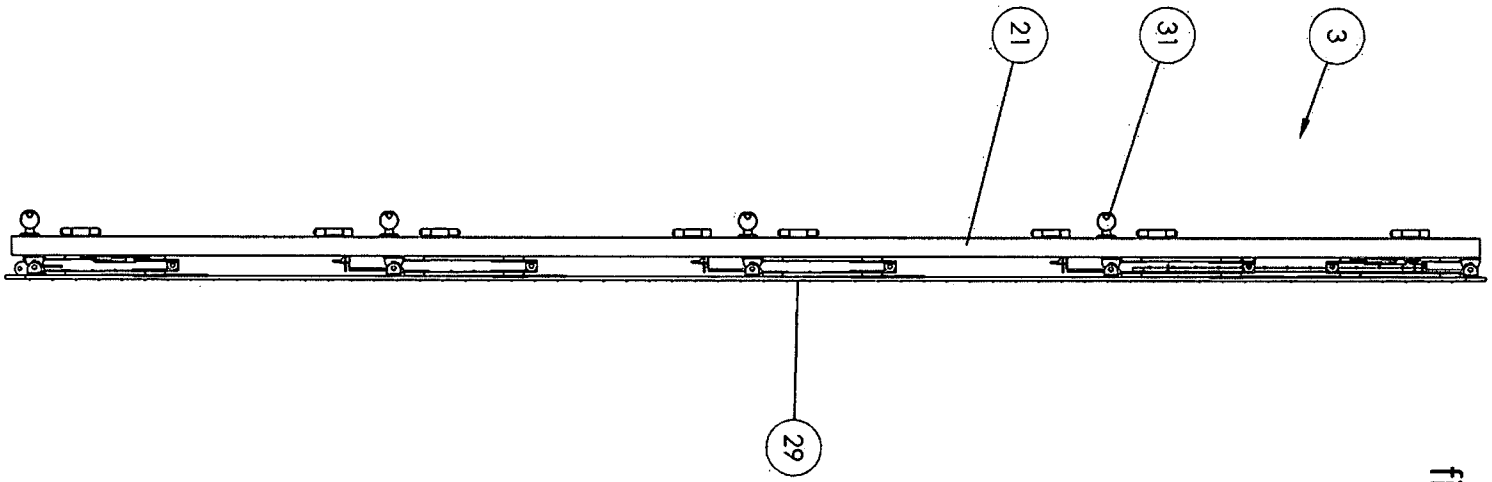
FIG. 6 is a side view of a module of the folded-up interior structure
Figure 7:
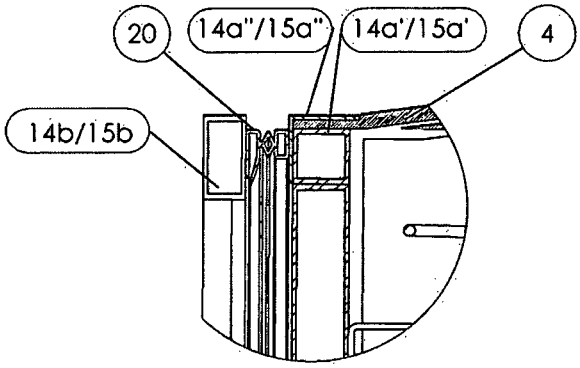
FIG. 7 is a side view of a detail of the façade
Figure 8:
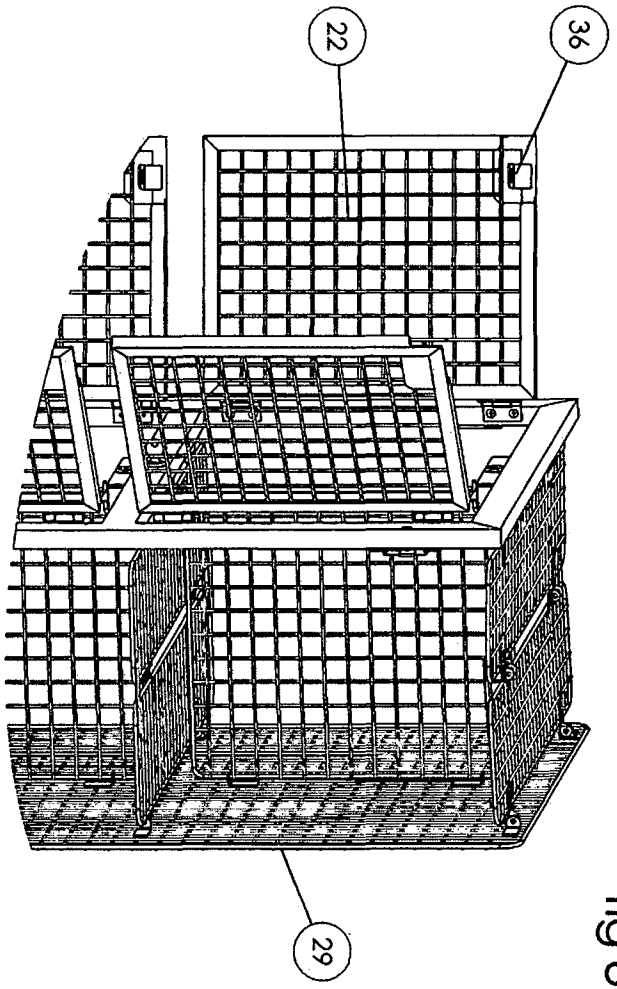
FIG. 8 is a side view of a compartment
Figure 9:
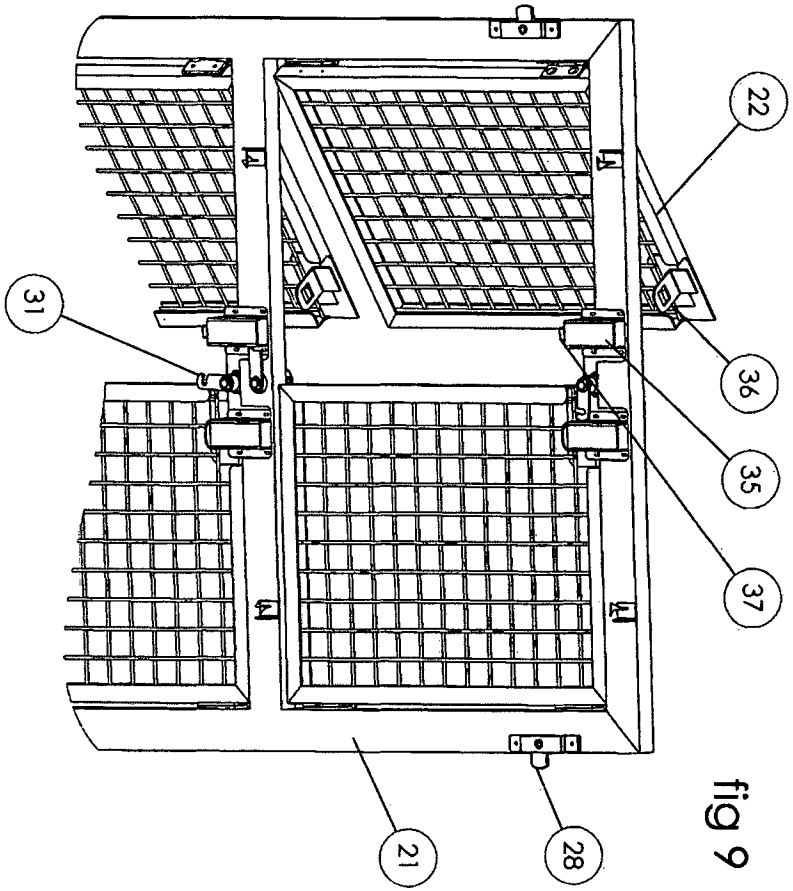
FIG. 9 is an interior view of the frame of the interior structure
Figure 10:
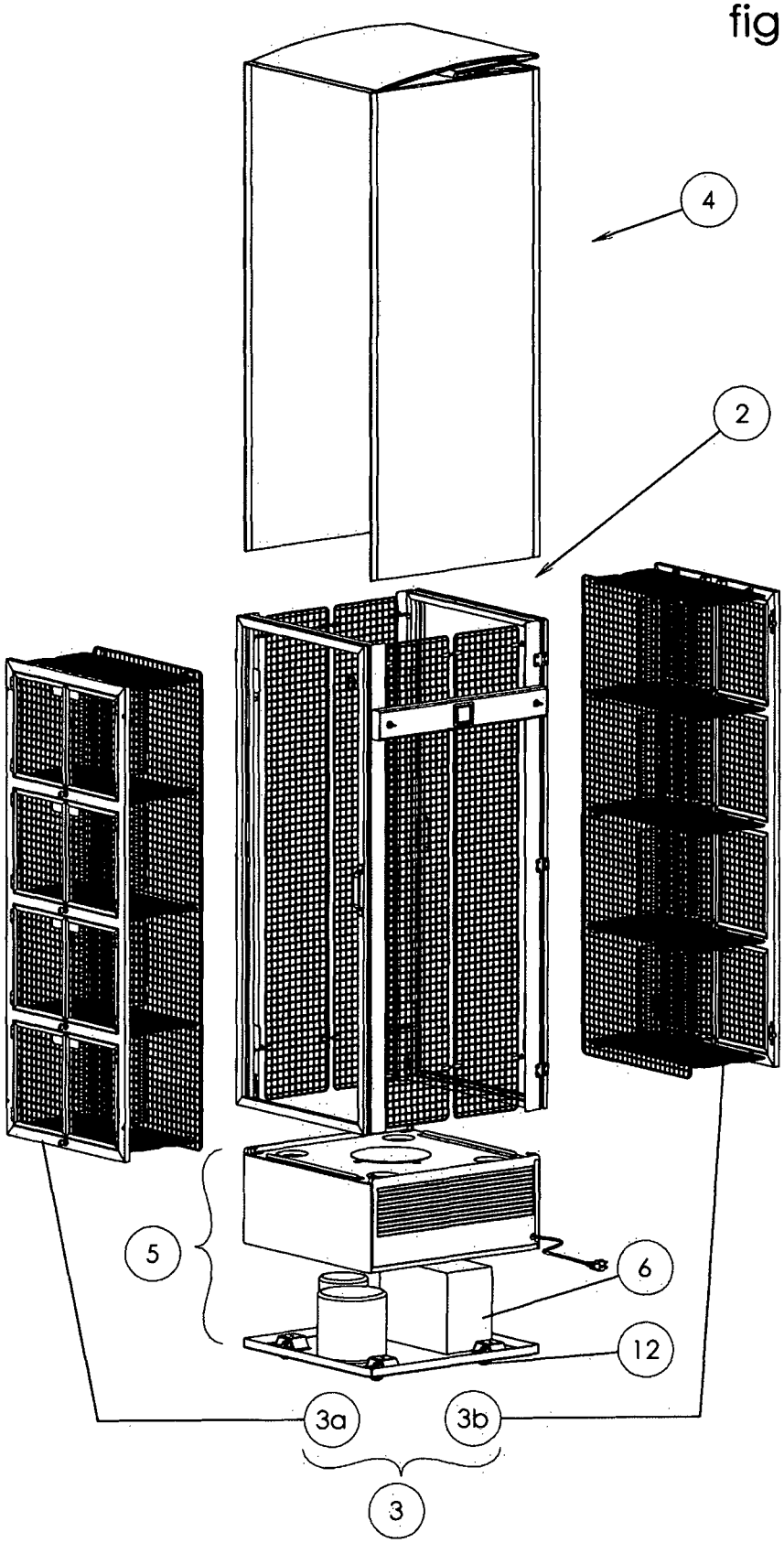
FIG. 10 is an exploded view of the device.

The foldable exterior structure (2) [FIGS. 3 and 4] comes to be positioned on the base (5). It is in the form of a rectangular parallelepiped, comprising a front façade (14), a rear façade (15), a right side (16), a left side (17), an open bottom (19), and an open top (18).

The bottom (19) and the top (18) have the same dimensions as the lower part and the upper part (7) of the base (5). To ensure sealing between the base (5) and the foldable exterior structure (2) when said structure is positioned on said base (5), a seal or sealing means is attached over the periphery of the bottom (19) of the exterior structure (2). According to a variant, a seal may be fixed over the periphery of the upper part (7) of the base (5).

The front façade (14) and the rear façade (15) are hermetic façades, which are open and connected to a refrigerator door (14*b*, 15*b*), which ensures closure. Each façade comprises a rectangular framework (14*a*, 15*a*) over its periphery. The framework (14*a*, 14*b*) is formed by a rectangular fitting (14*a*', 15*a*') that is connected, on its two vertical walls, to an L-shaped angle iron (14*a*", 15*a*") attached such that one of the sides of said angle iron is parallel to one of the sides (16, 17) of the exterior structure (2). The angle iron (14*a*", 15*a*") helps to seal the device (1) and to attach the isothermal cover (4). The refrigerator door (14*b*, 15*b*) that is mounted on hinges (14*c*, 15*c*) is attached to the exterior face of the framework (14*a*, 15*a*). In order to ensure the sealing between the framework (14*a*, 15*a*) and the door (14*b*, 15*b*), a flexible seal (20) is attached over the entire interior periphery of the door.

The right side (16) and the left side (17) of the foldable exterior structure (2) are wire-screened. This wire screen has two functions: letting the cold circulate through the entirety of the foldable structure (2) and preventing any undesired intrusion.

The right side (16) of the foldable structure (2) is divided into two equal parts (16*c*, 16*c*') separated by a central hinge (16*a*) extending from the top (18) to the bottom (19). Each of its sides, adjoining the front façade (14) on one side and the rear façade (15) on the other side, is also mounted on a lateral hinge (16*b*).

The left side (17) is produced in the same structure; it is divided into two parts (17*c*, 17*c*') with a central hinge (17*a*) and two lateral hinges (17*b*).

The hinges on the sides (16, 17) of the exterior structure are folding means which allow said structure (2) to be easily folded up and opened out. By pressing on the front façade (14) and rear façade (15), pressure is exerted on the two parts of each side (16*c*, 16*c*', 17*c*, 17*c*'), which fold around their central hinge (16*a*, 17*a*) while folding down against one another due to the pivoting ensured by the lateral hinges (16*b*, 17*b*). The front façade (14) and the rear façade (15) are thus positioned against one another, and are merely separated by the wire screens folded from the right side (16) and left side (17). When the exterior structure (2) needs to be opened out, it is thus sufficient to pull on the two façades (14, 15) simultaneously, with this expanding movement resulting in the other sides (16, 17) opening out.

According to a variant, the top (18) of the foldable exterior structure (2) is wire-screened and comprises a central hinge and two lateral hinges, the central hinge separating the top into two equal parts, said hinges extending from the right side (16) to the left side and allowing the top to fold up.

The wire-screened walls of the right side (16) and left side (17) comprise, on their interior faces, attachment rails connected to U-shaped slides. Each part of each side (16*c*, 16*c*', 17*c*, 17*c*') comprises three slides attached horizontally and the slides of the adjoining parts (16*c*/16*c*' and 17*c*/17*c*') are associated in pairs so as to form three horizontal axes on each side (16, 17). The pairs of slides on the right side (16)

are attached at the same level as the pairs of slides on the left side (17). Said slides strengthen the installation of the interior structure (3) in the exterior structure (2). They may also be used to receive conventional shelves when the interior structure (3) is not installed in the exterior structure (2).

Once folded out, the exterior structure is positioned on the base (5). Each of the two frameworks (14*a*, 15*a*) on the front façade (14) and rear façade (15) comprise, on its side adjoining the base (5), when the base (5) and the exterior structure (2) are connected, two holes that are positioned on the rods (11*a*) that are of complementary shape and dimensions and are provided on the base (5). When connected to the rods (11*a*), the holes ensure that the exterior structure (2) is guided into position and retained on the base (5). The attachment is strengthened by four toggle fasteners (13) positioned on the interior part of the framework of the rear façade (15*a*) and the front façade (14*a*). The toggle fasteners (13) become locked in the hooks (11*b*) on the base (5).

Once the exterior structure (2) is opened out, positioned and attached to the base containing the refrigerating unit (6), it is possible to install the isothermal cover and the interior structure (3).

The isothermal cover (4) or isothermal insulating means is made of a flexible isothermal material and covers the right side (16), the left side (17), and the top (18) of the exterior structure (2). The cover is formed in one piece and the dimensions thereof correspond to the dimensions of the walls that it covers. On the sides (17, 18), the cover is inserted into the framework (14*a*, 15*a*) of the façades (14, 15), between the fitting (14*a*', 15*a*') and the angle iron (14*a*", 15*a*"). It is then screwed to the framework (14*a*, 15*a*).

When the isothermal cover (4) is positioned on the exterior structure (3), the assembly formed by these two elements can be folded up and opened out depending on need and the purpose for which the device (1) is being used.

The attachment of the isothermal cover (4) to the foldable exterior structure (2) is finished by an attachment bar (32) that is attached to each of the sides (16, 17) of the exterior structure. The bar has a length that is equal to the width of the sides (16, 17). The bar is attached to the framework (14*a*, 15*a*) of the façades (14, 15) of the structure at each of its ends by an attachment means (33). According to a preferred embodiment, the attachment means (33) is an anti-tamper screw of which the head is a specific shape that cannot be screwed in or unscrewed using a standard screwdriver, but requires a customized tool to be used. The screw (33) passes successively through the angle iron (14*a*", 15*a*"), the isothermal cover (4), and the fitting (14*a*", 15*a*") of the framework (14, 15) to which the attachment bar is screwed, ensuring that all these elements are held in place. According to a variant, the attachment means (33) may be a key lock.

The attachment bar (32) also comprises a removable computerized reader (34) that controls the opening of the doors that give access to the compartments (24, 25, 26, 27), as described above.

According to a variant, the attachment bar (32) comprising the computerized reader (34) is replaced with two computerized readers (34) attached to each of the frameworks (14*a*, 15*a*) by a security-protected attachment means, each of the computerized readers controlling the opening of the compartments located on the side on which it is positioned.

According to a preferred embodiment, the foldable interior structure (3) [FIGS. 5, 6, 8 and 9] is made up of two identical foldable modules (3*a* and 3*b*), which are movable and separate from one another, one (3*a*) being intended to be inserted into the foldable exterior structure (2) through the front façade (14), and the other (3*b*) being intended to be inserted into the exterior structure through the rear façade (15). Each of the modules (3*a*, 3*b*) fills half of the interior volume of the foldable exterior structure (2).

Since the two modules are entirely identical, the description of one (3*a*) also describes the other (3*b*).

The foldable interior module (3*a*) is made up of a frame (21) to which doors (22) are attached, which are connected to a wire-screened structure (23) forming compartments.

The frame (21) is rectangular and the periphery thereof has dimensions allowing it to be inserted very precisely into the framework (14*a*, 15*a*) of the façade (14, 15). The frame (21) is made up of two vertical uprights (21*a*), a top cross-member (21*b*) connecting the top ends of the uprights (21*a*), a bottom cross-member (21*c*) connecting the bottom ends of the uprights (21*a*), and three intermediate cross-members (21*d*). The uprights (21*a*), the top cross-member (21*b*), and the bottom cross-member (21*c*) of the frame (21) form the periphery of said frame (21). Uprights and cross-members are formed by hollow tubes which allow the electronic cabling to be connected, with the wires passing through the inside of the uprights and cross-members. Two locks (28) are attached to the interior part of each of the two uprights (21*a*) of the frame (21), the bolts of which locks engage in corresponding holes in the framework (14*a*, 15*a*) of the façade (14, 15). These locks are provided with keys which allow the interior structure (3) to be attached to the exterior structure (2) and to be locked and unlocked in a security-protected manner. The intermediate cross-members (21*d*) are spaced at regular intervals so as to form four equal rectangles forming the façade of four large compartments (24, 25, 26, 27) in the interior of the frame. Each of the façades of said compartments (24, 25, 26, 27) is closed by two wire-screened doors (22) that are attached to the uprights (21*a*) of the frame (21) by hinges.

The frame (21) equipped with doors (22) is connected to a wire-screened structure (23) that forms the interior of the large compartments (24, 25, 26, 27). The wire-screened structure comprises a bottom wall (29) positioned in parallel with the frame (21), the bottom wall being as tall as the frame (21), but slightly less wide than said frame. When the interior module (3*a*) is opened out, the bottom wall (29) is located in the center of the interior volume of the exterior structure (2) and is joined to the bottom wall of the second module (3*b*).

The wire-screened structure (23) also comprises five horizontal walls (30*a*, 30*b*, 30*c*, 30*d*, 30*e*) extending from the bottom wall (29) to the frame (21) of the interior module (3*a*, 3*b*), perpendicularly thereto. Each of the horizontal walls (30) is attached in the axis of the five cross-members of the frame (21*b*, 21*c*, 21*d*) and they each delimit four equal volumes that form the interior of the four large compartments (24, 25, 26, 27). The uppermost horizontal wall (30*a*) forms the top of the foldable interior module (3*a*, 3*b*). The four other horizontal walls (30*b*, 30*c*, 30*d*, 30*e*) form the shelves on which the delivered goods will be placed.

In order to allow the module (3*a*, 3*b*) to fold up, each of the horizontal walls (30*a*, 30*b*, 30*c*, 30*d*, 30*e*) comprises three hinges forming folding means: a hinge connecting the horizontal wall to the bottom wall (29), a central hinge, and a hinge connecting the horizontal wall to the frame (21). In the installation phase of the device (1), the internal module (3*a*, 3*b*) is inserted into the external structure through one of the façades. It is positioned and attached by the locks (28) that connect the frame (21) of the internal module (3*a*, 3*b*) to the framework of the façade (14*a*, 14*b*). It is then sufficient to exert pressure on the wire-screened structure (23) so that it opens out and the walls (30*a*, 30*b*, 30*c*, 30*d*, 30*e*) are positioned on the horizontal. The interior horizontal walls (30*b*, 30*c*, 30*d*), located between the uppermost horizontal wall (30*a*) and the lowermost horizontal wall (30*e*), come to be positioned within the slides that are positioned on the interior of the right and left sides (16, 17) of the exterior structure (2). The slides make it possible to strengthen and support the horizontal walls, which are intended to receive loads of several kilograms. To fold up the structure, the bottom wall (29) should be pulled towards the frame, this movement causing the horizontal walls (30*a*, 30*b*, 30*c*, 30*d*, 30*e*) to fold upwards, by means of a rotational movement of the lateral and central hinges.

Each of the large compartments (24, 25, 26, 27) comprises a vertical wire separating screen (24*a*, 25*a*, 26*a*, 27*a*) that forms a means for adapting the volume of the compartment. This wire screen is attached to the wire-screened structure (23) at just one of its sides, by a vertical hinge positioned in the center of the bottom wall (29). Therefore, the vertical wire screen (24*a*, 25*a*, 26*a*, 27*a*) remains movable and can either stay positioned in parallel with the bottom wall (29) or be positioned perpendicularly to said bottom wall. This latter position allows a large compartment (24, 25, 26, 27) to be separated into two parts, thus producing two small compartments (24'/24", 25'/25", 26'/26", 27'/27"), each of the small compartments being closed by a door (22). When all the vertical wire screens (24*a*, 25*a*, 26*a*, 27*a*) are positioned perpendicularly to the bottom wall, each foldable interior module (3*a*, 3*b*) is divided into eight small compartments (24'/24", 25'/25", 26'/26", 27'/27"). A means (31) for locking each vertical wire screen is provided on the cross-members (21*b*, 21*c*, 21*d*) of the frame. This is a key lock that is accessible on the exterior part of the cross-member and actuates a locking hook located on the interior part of the frame (21), said hook becoming hooked into the vertical wire screen and retaining it in this position in a security-protected manner due to the locking. Therefore, a person who has access to one of the small compartments cannot access the other adjoining compartment without authorization.

The opening of each door is controlled by an electronic system that actuates an electric strike (35) or solenoid lock that is attached behind each door (22) and is connected by wires to the computerized reader (34) on the attachment bar (32). The electric strikes (35) are attached to the interior part of the top cross-member (21*b*) and of the intermediate cross-members (21*c*) of the frame (21) of the interior structure (3). Two strikes (35) are attached to each of these cross-members, with each of the strikes (35) controlling the opening of a door (22). The electric strikes (35) are boxes containing an electronic system, extended by a movable piston (37) that extends beyond the cross-member to which the strike (35) is fixed. Each of the doors (22), which are each associated with a strike (35), comprises, on its interior face, an eyelet (36) which is rigidly connected to the door and is positioned such that the piston of the strike (37) is received therein when the door (22) is closed. If the electrical system is not actuated, the piston is kept extended and thus ensures that the door is locked by being inserted into the eyelet (36). When an electrical signal is supplied to the strike (35), the piston (37) is pulled inwards and releases the door (22), which can then be opened.

The electric strikes (35) are connected to the computerized reader by wires passing through the interior of the frame (21) of the interior structure (3).

Once the exterior structure (2) is attached to the base (5), is covered by the isothermal cover (4) and the interior structure (3) is installed, the device is ready to be used.

A customer wishing to purchase fresh produce and have it delivered to the device (1) places an order with the supplier and receives a QR code by email or mms. On the agreed day and time, the customer presents their QR code to the computerized reader (34), which has been programmed to associate the code with one (or more) compartments in which the goods are being stored and to allow the compartment to open when the code is read. Depending on the size of the delivery, the QR code may unlock one door (22) corresponding to a small compartment (24'/24", 25'/25", 26'/26", 27'/27") or two doors (22) corresponding to a large compartment (24, 25, 26, 27). Once the deliveries are complete, the device can be rapidly dismantled and folded up, which makes it easier to handle and provides significant gains in terms of space during transport and storage.

According to a variant, the opening of the doors (22) may be ensured by any other type of opening, i.e. key, electronic code lock, etc.

Numerous variants that may be combined can be provided here without departing from the scope of the invention as defined above.

The non-substantial modifications that would result, in a manner obvious to a person skilled in the art, from the use or manufacturing required in the patent without altering the original provisions would only be mere technical equivalents, and they are also covered by the scope of the present invention.

The invention claimed is:

1. Movable, portable, refrigerated device (1), characterized in that it is formed by connecting three elements that can be reversibly dismantled, the device comprising:

a base (5), a foldable exterior structure (2) positioned on the base, a foldable interior structure (3) with compartments which is built into the foldable exterior structure, said base (5) containing a refrigerating unit (6), said foldable exterior structure (2) comprising at least one hermetic façade (14, 15) formed by a side closed by a refrigerator door (14*b*, 15*b*), with the other sides of said structure (2) being covered by a removable isothermal insulating means (4), said foldable interior structure (3) with compartments being formed by at least one module (3*a*, 3*b*) comprising a façade frame (21), a vertical wire-screened wall (29) parallel to said frame (21), and at least two horizontal wire-screened walls (30) positioned between the frame (21) and the vertical wall (29), the assembly (21, 29, 30) delimiting at least one enclosed volume inside the foldable exterior structure (2), said enclosed volume forming a compartment (24, 25, 26, 27) comprising at least one movable partition (24*a*, 25*a*, 26*a*, 27*a*) that is fixed by a hinge to the vertical wall (29), said movable partition forming a means for adapting the volume of the compartment into two sub-compartments (24', 24", 25', 25", 26', 26"), each of said compartments (24, 25, 26, 27) and sub-compartments (24', 24", 25', 25", 26', 26") being closed by at least one door (22) comprising a security-protected access means (35), said door (22) being rigidly connected to the frame (21).

2. Movable, foldable, refrigerated device (1) according to claim 1, characterized in that the base (5) and the foldable exterior structure (2) comprise means (11, 13) for mutual rigid connection, and sealing means.

3. Movable, foldable, refrigerated device (1) according to claim 1, characterized in that the foldable exterior structure (2) and the foldable interior structure (3) comprise means (28) for mutual rigid connection.

4. Movable, foldable, refrigerated device (1) according to claim 1, characterized in that the isothermal insulating means (4) is rigidly connected to the foldable exterior structure (2) by attachment means on said hermetic façade (14, 15).

5. Movable, foldable, refrigerated device (1) according to claim 1, characterized in that at least two of the walls of the exterior structure (2) comprise hinges forming folding means.

6. Movable, foldable, refrigerated device (1) according to claim 1, characterized in that said horizontal walls (30) of the foldable interior structure (3) comprise hinges forming folding means.

7. Movable, foldable, refrigerated device (1) according to claim 1, characterized in that the foldable interior structure (3) comprises at least one means (31) for locking said movable partition (24*a*, 25*a*, 26*a*, 27*a*).

8. Movable, foldable, refrigerated device (1) according to claim 1 characterized in that the security-protected access means (35) for said door (22) of the foldable interior structure (3) is a solenoid lock.

9. Movable, foldable, refrigerated device (1) according to claim 1, characterized in that the security-protected access means (35) for said door (22) of the foldable interior structure (3) is an electric lock.

10. Movable, foldable, refrigerated device (1) according to claim 1, characterized in that the device comprises a computerized reader (34) connected to the security-protected access means (35) for said door (22) of the foldable interior structure (3), said computerized reader forming a means for controlling the opening of said door (22).

* * * * *